US005836115A

United States Patent [19]

Clay et al.

[11] Patent Number: 5,836,115

[45] Date of Patent: Nov. 17, 1998

[54] FOUNDATION WATERPROOFING AND DRAINAGE SYSTEM

[76] Inventors: Randy K. Clay, 9720 Hudson Ct., Thornton, Colo. 80229; William H. Grisinger, III, 9535 West 54th Pl., Arvada, Colo. 80002

[21] Appl. No.: 762,398

[22] Filed: Dec. 9, 1996

[51] Int. Cl.[6] ..... E02D 19/00; E02D 31/00

[52] U.S. Cl. ..... 52/169.5; 52/169.14; 52/741.11; 52/741.13; 52/302.3; 405/38; 405/43; 405/50; 405/51

[58] Field of Search ..... 52/169.5, 169.14, 52/741.11, 741.13, 302.3; 405/36, 38, 43, 44, 45, 46, 47, 48, 50, 51

[56] References Cited

U.S. PATENT DOCUMENTS

| | | | |
|---|---|---|---|
| 245,721 | 8/1881 | Henning | 405/50 X |
| 870,433 | 11/1907 | Hodges | 405/50 |
| 1,840,397 | 1/1932 | Keyes | 52/169.1 X |
| 3,287,866 | 11/1966 | Bevilacqua | 52/302.3 |
| 3,625,010 | 12/1971 | Hakundy | 405/38 |
| 3,754,362 | 8/1973 | Daimler et al. | 52/169.5 |
| 4,045,964 | 9/1977 | Barclay | 405/50 |
| 4,290,252 | 9/1981 | Demirel et al. | 52/741.13 |
| 4,333,281 | 6/1982 | Scarfone | 52/302.3 |
| 4,538,386 | 9/1985 | DiCello | 52/169.5 |
| 4,538,836 | 9/1985 | Barnett et al. . | |
| 4,592,676 | 6/1986 | Gilgen | 405/36 |
| 4,612,742 | 9/1986 | Bevilacqua . | |
| 4,877,350 | 10/1989 | DiFiore . | |
| 4,907,385 | 3/1990 | Biodrowski . | |
| 5,035,095 | 7/1991 | Bevilacqua . | |
| 5,100,258 | 3/1992 | VanWagoner | 405/36 X |
| 5,248,225 | 9/1993 | Rose . | |
| 5,494,696 | 2/1996 | Repka . | |
| 5,551,797 | 9/1996 | Sanford . | |
| 5,642,967 | 7/1997 | Swain et al. | 405/229 |

FOREIGN PATENT DOCUMENTS

| | | | |
|---|---|---|---|
| 29400 | 5/1981 | European Pat. Off. . | |
| 1484356 | 4/1969 | Germany | 405/45 |
| 2263896 | 7/1974 | Germany | 52/169.5 |

OTHER PUBLICATIONS

"Plastic Film is Permanent Moisture Barrier", Construction Methods and Equipment, p. 87 Mar. 1955.

"Home Landscaping and Maintenance on Swelling Soil", by Candace L. Jochim, published by the Colorado Geological Survey, Revised Fifth Printing, 1987 (first printing 1981).

"Home Construction on Shrinking and Swelling Soils", by Wesley G. Holtz and Stephen S. Hart, for the American Society of Civil Engineers, Oct. 1978.

*Primary Examiner*—Wynn Wood Coggins
*Assistant Examiner*—Laura A. Callo
*Attorney, Agent, or Firm*—Ramon L. Pizarro

[57] ABSTRACT

A system and method for preventing the accumulation of water below and about a building and soil surrounding the building, the building having a foundation built on disturbed soil, which is in turn surrounded by undisturbed soil and the foundation extending to a depth. The system includes at least one trench section about the foundation, the trench being at least as deep as the disturbed soil about foundation and having sides and a bottom. At least one side of the trench being bounded by undisturbed soil. The trench section also includes a first end and a second end, the trench bottom having a slope between the first end and the second end, the second end terminating in a sump pit. An impermeable liner over the sides and bottom of the trench and extending into the sump pit. The impermeable liner is inserted into and held against the undisturbed soil that forms a side of the trench by a substantially rigid edging material, so that water filtering through the disturbed soil about the building foundation will reach undisturbed soil and flow over the undisturbed soil, where it will flow over the rigid edging material and into the lined trench, and then into the sump pit, so that water in the disturbed soil is collected in the sump pit before accumulating under and about the building foundation.

13 Claims, 5 Drawing Sheets

FOUNDATION WATERPROOFING AND DRAINAGE SYSTEM

BACKGROUND OF THE INVENTION (a) Field of the Invention

This invention generally relates to systems for preventing the filtration of water under structures and for draining the soil around a structure. And more specifically, but not by way of limitation, to a system and method for repairing drainage systems in existing structures as well as systems for new construction in order to avoid the swelling of soil under the structure.

(b) Discussion of Prior Art

A very important problem which must be taken into consideration in the construction of homes and buildings is the nature of the soil on which the building is to be erected. One problem in particular which must be addressed is the problem of the effects of building over what are commonly referred to as expansive soils. Expansive soils typically include soils which contain significant amounts of clay, such as bentonite and the like.

The mechanism by which these soils expand is relatively well understood. The expansive properties of clay soil are primarily due to the crystal structure of the montmorillonite or bentonite mineral that constitutes a large fraction of the clay which is made up of minute plates which can draw and hold water between the plates. The ability of bentonite to expand is dramatic, and expansions the doubling of the volume of the material are not uncommon. Other minerals include hydrated calcium sulfate, which is moderately expansive as compared to the bentonite.

Construction over these expansive soils has been accepted, however the structure is often unable to sustain or withstand the effects of the expansion of the soil below the building. Approaches that have been taken to try to improve the building's ability to survive over an area of expansive soil include providing drainage systems, reinforcing the floor or slab over the soil, providing areas of flexible material that allow the soil to expand, and the incorporation of pylons or quezons which reach to depths beyond the areas containing expansive soils.

Examples of known drainage systems include U.S. Pat. No. 5,551,797 to Sanford, which teaches a radial drainage system for the soil under the structure. U.S. Pat. No. 5,494,696 to Repka teaches the use of a permeable membrane about the periphery of the foundation of the structure in order to enhance the collection and working order of drain tile incorporated around the foundation. U.S. Pat. No. 5,248,225 to Rose teaches the use of an insulating, water diverting device that carries water away from the foundation. U.S. Pat. No. 5,035,095 to Bevilacqua teaches the use of a water tight cavity around the foundation in order to prevent water leakage through the foundation wall. U.S. Pat. No. 4,907,385 to Biodrowski teaches a drainage apparatus for use with hollow core block foundations. U.S. Pat. No. 4,877,350 to DiFiore teaches the use of trench filled with a variety of materials in order to enhance the drainage of the area surrounding the foundation. U.S. Pat. No. 4,612,742 to Bevilacqua teaches the use of a drain device that cooperates with hollow blocks in a foundation formed with hollow blocks. U.S. Pat. No. 4,538,836 to Barnett et al. teaches the use of a drainage and insulating material that is used in a diamond pattern below the building. European Patent 29,400 teaches placing a subsoil grid-drainage system under the foundation of the house.

A common approach at preventing the swelling of the expansive soils has been to provide impermeable liners that skirt the outer boundaries of the foundation. These liners are typically glued or tacked to the foundation, and then laid down around the building in a manner that allows water reaching the liner to flow away in a direction normal to the wall of the foundation.

None of the known methods has been able to reliably and cost effectively correct the problems associated with the drainage and prevention of the absorption of water by expansive soils under buildings. Thus, there remains a need for a method and system which can effectively drain and prevent water from entering the soil under the building.

SUMMARY

It has been discovered that the above problems, which had been left unsolved by the known prior art, can be solved by providing a system for preventing the accumulation of water below and in the soil about the building, where the building includes a foundation built on soil which was disturbed to erect the building which is surrounded by undisturbed soil. The system and method include:

a) at least one trench section about the foundation, the trench being at least as deep as the disturbed soil about foundation and having sides, and having at least one side being bounded by undisturbed soil, and a bottom; and b) an impermeable liner over the sides and bottom of the trench, so that water filtering through the disturbed soil about the building foundation will reach undisturbed soil and flow over the undisturbed soil, into the lined trench where it can be drained away before accumulating under and about the building foundation.

It has been discovered that undisturbed soil does not absorb as much water, and therefore does not expand as much as disturbed soil. Therefore, by providing a trench which includes at least one side against undisturbed soil and lining the sides of the trench with an impermeable material, one can effectively drain away water before it can collect below the foundation or surrounding areas with disturbed soil.

According to another very important aspect of the invention a substantially rigid strip of impermeable material is used to drive and hold the impermeable liner within the area of undisturbed soil along the ditch. The substantially rigid edge is attached to the liner and driven into the undisturbed soil in order to provide a flow path into the lined ditch.

In order to provide adequate drainage to the system, perforated pipe, surrounded by clean fill gravel, is placed within the lined ditch. In accordance with another aspect of the invention, the perforated pipe is placed in the ditch in a manner that allows drainage to the corners of the structure. At each corner of the structure is placed a sump pit, which preferably houses an automatic sump pump. The impermeable liner is draped into the sump pit to provide a smooth flow route for water that does not enter the perforated pipe.

Since the system preferably includes at least two sump pits, it allows the use of a fail safe drainage structure. This drainage structure allows the placement of high points of the perforated pipe and the lined ditch at diagonally opposite corners under the structure, and the sump pits at the remaining diagonally opposite corners. This ensures that if one sump pump fails, or if one ditch and perforated pipe becomes clogged, the water collected in the ditch and pipe may flow over the diagonally opposed high points and into the remaining sump pit.

Thus it will become apparent that it is an object of the instant invention to collect and drain water before it reaches the soil under and about a structure.

Further, it will become apparent that the instant invention provides a system and method for ensuring fail safe drainage and collection of water before it reaches the soil under the structure.

Still further, it is an object of the instant invention to provide a system and method for obviating drainage routes which allowed water to seep under the structure.

It should also be understood that while the above and other advantages objects and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
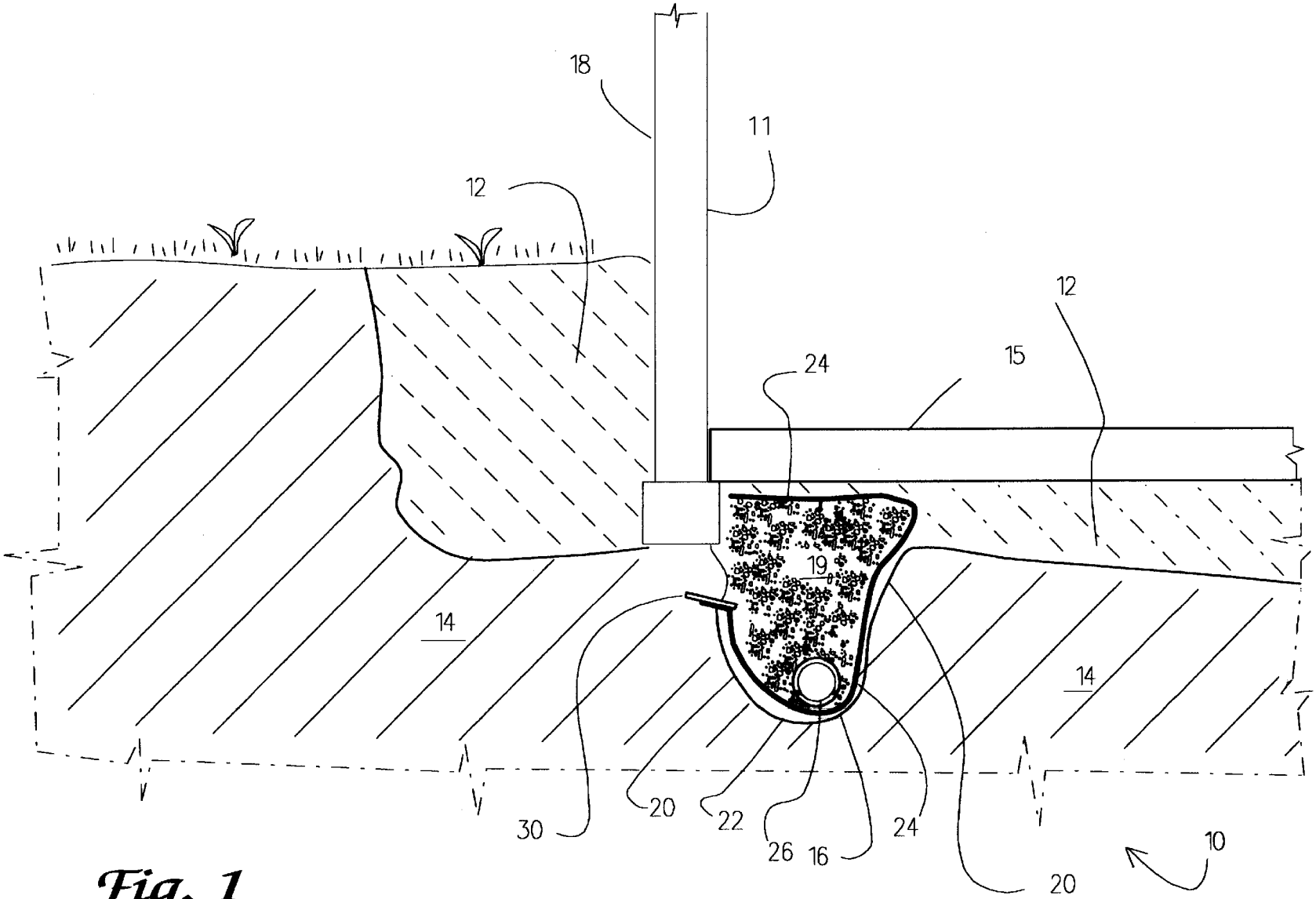
FIG. 1 is an end sectional view showing the drainage system as applied in repair applications.

Referring now to FIG. 1, where a cross section of a first application of a system 10 in accordance with the instant invention, which serves for preventing the accumulation of water below and about a building and the soil surrounding the building. The system and method as taught herein may be used as part of new construction or as a repair or correction work on an existing structure.

When building the foundation walls 11 for a building, such as a house, one first digs out the area where the foundation is to be poured. Then forms which mold footings 13 and the foundation walls 11 are placed and filled with concrete. After the walls 11 of the foundation are set one then fills, or as commonly known in the art "backfills" to a desired finished grade level the areas around the foundation walls, footings, and areas where the floor slab 15 is to be poured at a later time. When carrying out the backfill operation the fill soil is compacted in order to stabilize this material below the house. However, the recompactment will typically not result in a densely packed soil. Thus, as shown on FIG. 1, an area of disturbed soil 12 that cannot truly be fully re-compacted to the same tightness as surrounding undisturbed soil 14 is left below and around the foundation of the building.

This disturbed soil 12 typically exhibits high porosity and high absorption capabilities, especially as compared to the undisturbed soil 14.

One of the most serious problems associated with the disturbed soil 12 is that it allows water to seep under the structure where the water can reach any existing expansive soils. In order to prevent the seepage of water to areas under the structure, and to prevent the accumulation of water under the structure, the system 10 of the instant invention provides at least one trench section 16 about the foundation 18. The trench section is designed to collect and carry away any water that may be filtering towards below the structure.

The trench 16 is preferably at least as deep as the disturbed soil 12 about foundation 18, and includes a gradient that allows water collected in the trench 16 to flow towards a sump pit 17, which has been shown on FIGS. 3 through 6. As shown on FIGS. 1 and 2, the trench 16 includes sides 20, with at least one side 20 that is bounded by undisturbed soil 14, and a bottom 22. In order to improve the ability of the trench 16 to carry water towards the sump pit 17, an impermeable liner 24 is placed in the trench 16, so that the liner 24 covers at least the sides 20 and bottom of the trench 16. The liner 24 is preferably of a polyethylene or other durable plastic material which can be draped into the trench 16.

Figures 2, 2A:
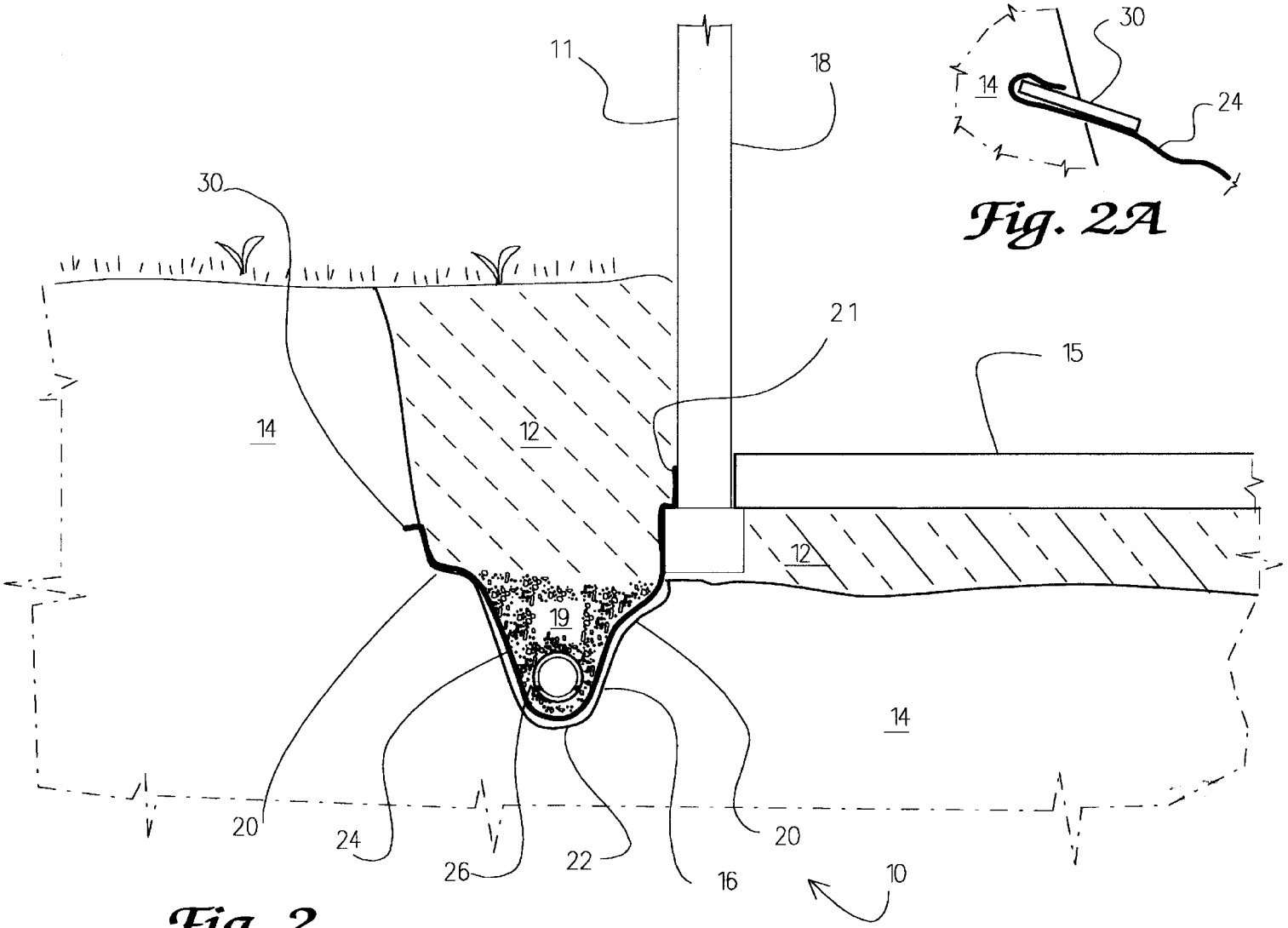
FIG. 2 shows an end section through the drainage system as applied for new construction.
FIG. 2A is a detail view showing one manner for wrapping the liner about the edge before driving the edge into undisturbed soil.

Referring now to FIG. 2, the installation of the system 10 along the inside of a structure will now be discussed. Installation of the system 10 along the inside, or below the floor slab 15 is preferred in a repair or improvement of an existing structure. Thus, when it is found that excessive amount of water is filtering into the areas below and about the structure, it would be preferable to correct the problem by installing the system 10 below the slab 15 and below or near the footings 13 that had been previously installed as part of the foundation installations.

Thus in order to install the system 10 one would first dig the trench 16 along, or substantially parallel to, the walls 11 of the foundation. The trench 16 is then covered with the impermeable liner 24. It is preferred that the liner 24 extend beyond the side 20 of the trench 16 that is bounded by disturbed soil 12.

As shown on FIG. 2, after the impermeable liner 24 has been placed over the trench 16, a long section of rigid edge 30 material should then wrapped by the liner 24 in the manner shown on FIG. 2A. The edge 30 and liner 24 should be wrapped in a section of liner next to the side 20 of the trench 16 that is bounded by undisturbed soil 14. The combined liner 24 and edge 30 should then be driven into the undisturbed soil 14 by means of a hammer or other appropriate tool. By driving the combined edge 30 and liner 24 into the undisturbed soil 14 one provides a smooth transition for water flowing over the tightly packed undisturbed soil 14 and into the lined trench 16, where the water may be collected and allowed to flow towards the sump pit 17.

Once the liner 24 has been placed over the sides 20 and bottom 22 of the trench 16, and the edge 30 has been driven into the undisturbed soil 14, it is highly preferred that clean gravel 19 be placed over the liner 24. Once a layer of gravel 19 has been place over the liner 24, a rigid perforated pipe 26 is placed over the gravel 19. Is it important to ensure that the pipe 26 maintains at least the same slope as the trench 16. The pipe extends into the sump pit 17, and should extend through the entire length of the trench 16.

The pipe 26 should then be covered with gravel 19 The section of liner 24 which extends over the side 20 of the trench 22 which is formed from disturbed soil 12, and which, as explained above, extends over the side 20 of the trench 22, should then be draped over the gravel 19 covering the perforated pipe 26. By covering the gravel with the section of liner 24, one may then further cover this section of liner 24 with soil in order to provide a proper support for the slab 15, which is to be poured.

It has been found that the sides 20 of the trench 16 should be approximately one to two feet deep and the bottom 22 should be from about six inches to about eighteen inches wide. The sides 20 should slope away from the bottom 22 in order to prevent the sides 22 from caving into the trench 16.

The edge 30 used with the system 10 should preferably be of a corrosion protected steel material, although it is contemplated that a strong plastic or other metal may also be used. In a preferred embodiment the liner 24 is wrapped over the edge 30 and the edge and liner are driven into the undisturbed soil by means of a hammer or other mechanical means. It should be noted that while it is contemplated that the liner 24 be wrapped around the edge 30, it is also contemplated that the liner could be fabricated with a built in edge, or the edge may be simply fabricated with a gripping or securing surface that can be used to hold the liner 24 against the edge 30. An example of this type of arrangement would include the use of an adhesive or of a mechanical clamping device to hold the liner 24 against the edge 30.

When using the system in new construction, it is contemplated that the trench 16 be incorporated in the areas about the foundation that extend away from the foundation as show in FIG. 2. The use of the system on the outside of the foundation versus on the inside of the foundation, as is done in repair installations, is primarily due to the fact that it is advantageous to use sloped surface of the area that has been excavated for the foundation 18. Thus, as shown on FIG. 2, the side 20 of the trench on which the edge 30 is incorporated will be the area of undisturbed soil which forms the side or sloping surface for the excavation for the foundation 18. It is important to note that the section of the original excavation that is to form side 20 of the trench 16 which is bounded by undisturbed soil 14 should have a gradient that allows water to flow into the trench 16. Thus, as shown on FIG. 2 the slope should be towards the foundation 18.

As shown on FIG. 2, in applications concerning new construction, the trench 16 may be conveniently installed on the outside of the foundation 18. In these applications the bottom 22 of the trench 16 will also be covered with gravel 19, as used in repair applications. A rigid perforated pipe 26 should also be placed over the gravel 19. As discussed in the application for repair installations, the perforated pipe 26 should extend substantially the entire length of the trench 16. However, it is important to note that the perforated pipe 26 enhances the performance of the system. Thus, in situations where large amounts of water are to be directed to flow into the sump pits 17, the perforated pipe 26 will allow rapid flow of water through the trench 16, and prevent overfilling of the trench 16. However, it is contemplated that the trench may be filled with gravel alone, and thus provide a highly porous flow path for the water being directed into the sump pits 17 over the liner 24.

Also shown on FIG. 2 is that, on the application for new construction, which preferably are installed on the outside of the foundation 18, the border the liner which covers the side 20 of the trench 16 which is nearest to the disturbed soil 12 should be tacked by means of an adhesive or mechanical means plus a sealing compound to the wall 11 at an area at near the trench 16 and which has been referred to as area 21 on FIG. 2 or otherwise attached to the side of the foundation 18. This will ensure that water flowing down a wall of the foundation 18 will flow into the trench 16, where it may be carried away into the sump pits 17.

Figure 3:
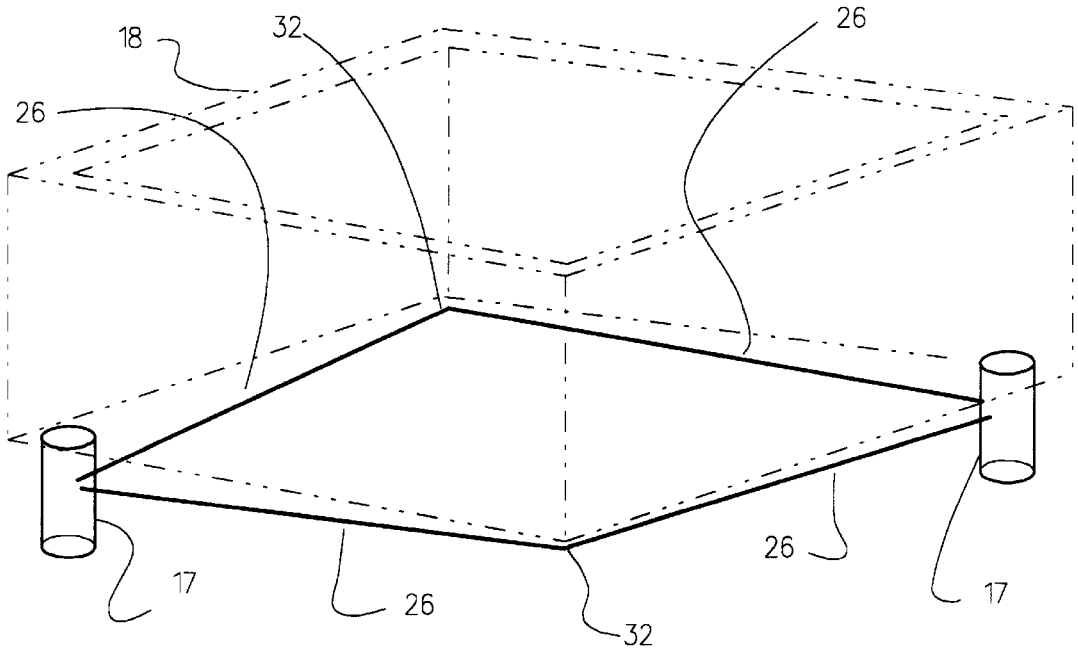
FIG. 3 is a perspective, schematic, view illustrating the sloping and routing of trenches a and hence the pipe leading to the sump pits which include the "fail safe" feature discussed herein.

Referring now to FIG. 3 it can be seen that two sump pits 17 are used in a highly preferred installation. The use of two sump pits allows the installation of two high points 32 in the routing of the pipe 26 or trenches 16. The use of two high points 32 provides a highly desirable "fail safe" feature to the invention. In the past, only a single sump pit, or a single low point for collection of water was used. A serious problem associated with this type of installation is that if expansive soil is found below one of the trenches, the swelling of the expansive soil, which can be as much as 200 percent, can dam up the trench or flow path to the sump pits 17. The use of two high points 32 provides an alternative route to water accumulated in the trench 16 or flow path towards the sump pit 17. Thus if one route becomes clogged or unusable, the water will fill up this route until it reaches the high point 32 where it will overflow towards the alternative sump pit 17.

Figure 4:
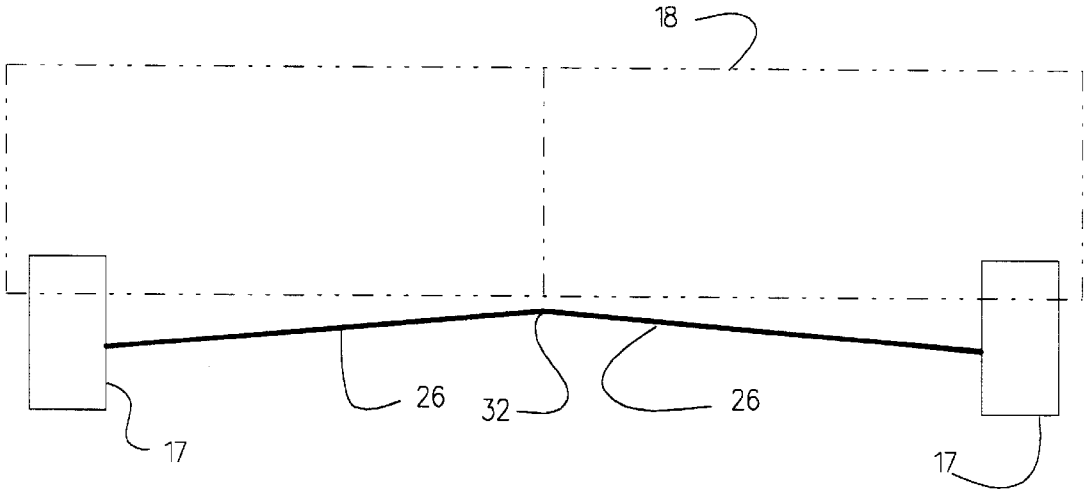
FIG. 4 is a schematic view, looking diagonally at a substantially square, foundation including two high points and the "fail safe" system for allowing water to flow into the sump pit.
Figure 5:
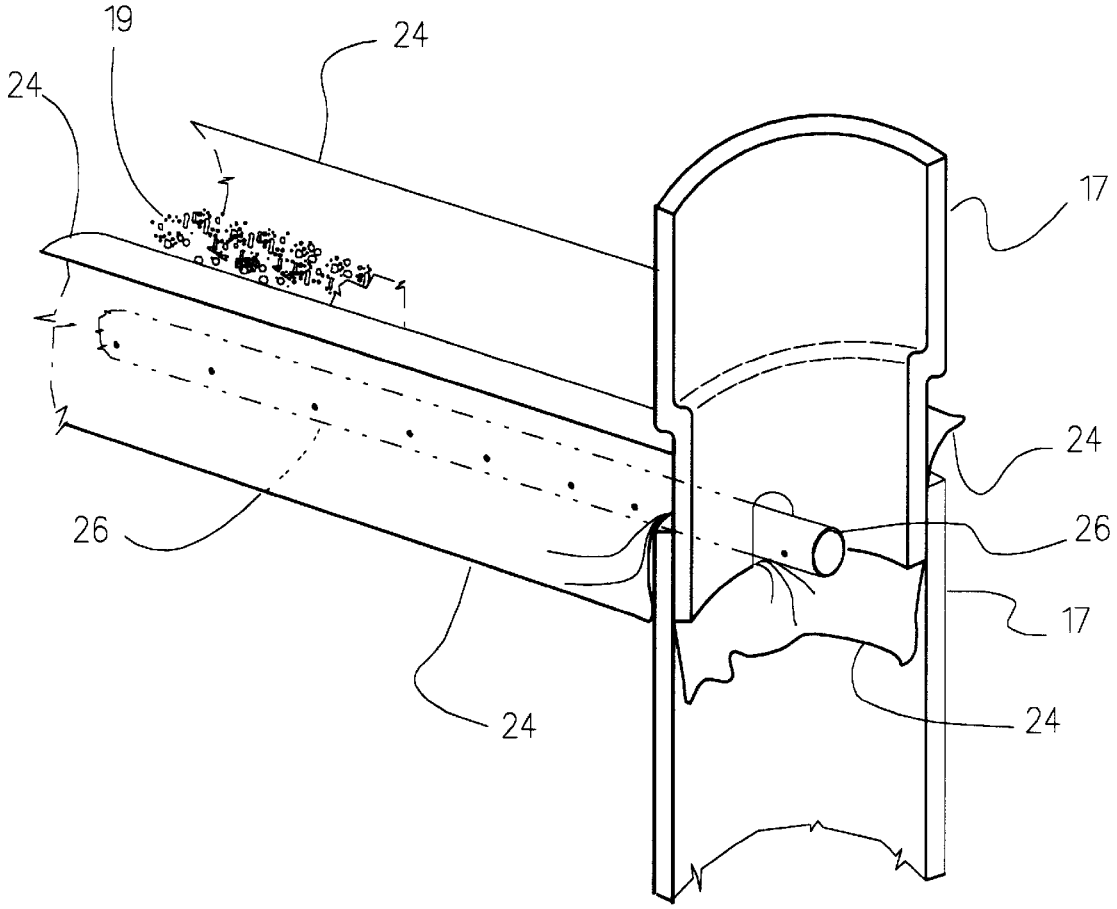
FIG. 5 is a perspective view showing the installation and draping of the liner into the sump pits in order to provide a system that provides an impermeable path into the sump pits.

The schematic view of the slope of the perforated pipe 26 shown on FIG. 4 is simply an elevational view looking diagonally at one of the corners of the foundation 18, and illustrating only one of the two high points 32. The other high point 32 is simply not visible in this view because it lies directly behind the illustrated high point 32 where the foundation has the geometry shown on FIG. 4.

The termination or intersection of the liner 24 and the sump pits 17 is also important for the acquisition of the full potential of this system. As shown on FIG. 5 the lining material 24 should not terminate outside the sump pit 17, but should be draped into the sump pit 17, and around the pipe 26. This arrangement will ensure that water collected within the lining 24 of the trench 16 will flow into the sump pit 17. Thus any water captured within the liner 24 of the trench 16 may flow into the sump pits 17 by first filtering into the perforated pipe 26 or by simply following the liner 24 into the sump pit 17.

Figure 6:
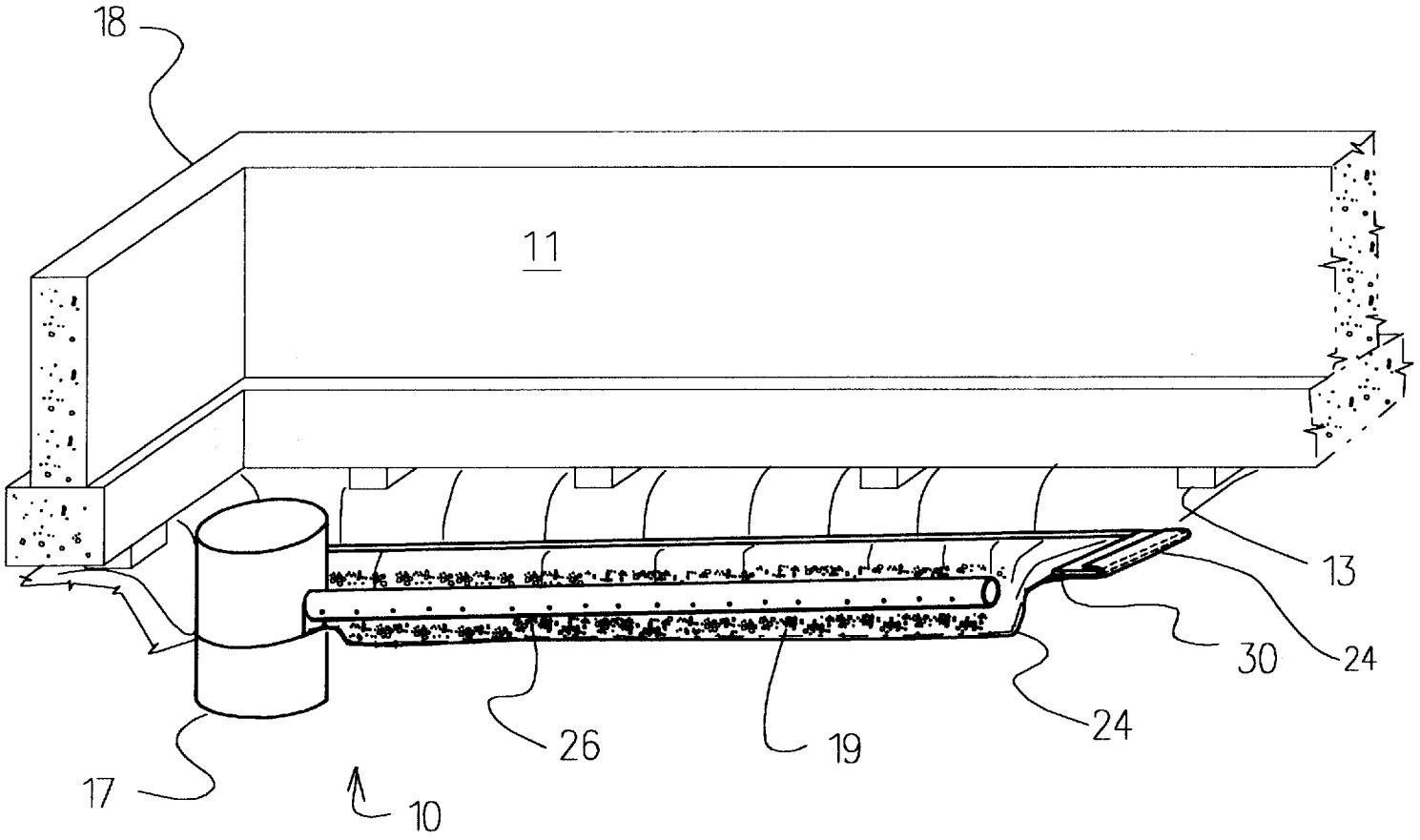
FIG. 6 shows an installation of the system at a location below the structure where the system was needed at only a section of the foundation or building area.

Still further, it is important to note that as shown on FIG. 6, the system may be used along a single section or area around the structure's foundation 18. It would be advantageous to use a single section in applications where expansive soils are found in only a limited area around or below the structure. Thus as shown on FIG. 6, the trench 16 is shown as not extending the entire length of the area below the foundation wall 11. Also, in the embodiment shown on FIG. 6, the trench 16 has been shown with the side 20, along disturbed soil 12, being cut away. The edge 30 has been installed along the length of the trench 16, and terminating in a short edge section inserted into undisturbed soil at the highest portion of the trench 16. The foundation has been shown on footings 13.

It should be appreciated that the instant invention may operate without the inclusion of the pipe 26. However, as discussed above, the performance of the system is enhanced by incorporating the perforated pipe 26.

Also, it should be appreciated that the use of gravel 19 within the trench 16 also enhances the operation of the system 10, but the system may also function without the use of gravel 19. The trench 16 may simply be filled with tubing or with sand or with other materials that will assist in maintaining the shape of the system during the backfill operation.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiment and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A method for preventing the accumulation of water below a grade level of a perimeter area about a building foundation and soil surrounding the building, the building foundation being on disturbed soil and extending to a depth below the grade level, the method comprising:

providing a trench about the foundation, the trench being at least as deep as the disturbed soil about the foundation and having a side bounded by an area of undisturbed soil;

providing an impermeable liner of a drapable material;

attaching the impermeable liner to the foundation, so that a portion of the liner is attached to the foundation and a portion of the liner is free;

providing a strip of substantially rigid edge material:

covering the trench with the free portion of the impermeable liner and placing at least a section of the free portion against the area of undisturbed soil;

attaching the strip of rigid edge material together with the free portion of the liner against the side of the trench and below the grade level, and filling the trench with fill material.

2. A method according to claim 1, wherein said step of providing the trench about the foundation further comprises:

providing a first end, a second end, a bottom, and sides, the second end terminating in a sump pit.

3. A method according to claim 2, wherein the step of filling the trench with fill material comprises providing gravel fill material, placing the gravel fill material over the bottom of the trench.

4. A method according to claim 3, and further comprising providing a section of perforated pipe, and placing the perforated pipe over the gravel, filling the trench with gravel to cover the perforated pipe, and filling the trench with backfill.

5. A method for preventing the accumulation of water below a grade level of a perimeter area about a building foundation and soil surrounding the building, the building foundation being on disturbed soil surrounded by undisturbed soil and extending to a depth below the grade level, the method comprising:

providing a trench about the foundation, the trench beginning at the grade level and being at least as deep as the disturbed soil about the foundation and having sides, at least one side being bounded by undisturbed soil, and a bottom;

providing an impermeable liner;

providing a substantially rigid edge section;

covering the trench with the impermeable liner;

driving the substantially rigid edge section together with the impermeable liner into undisturbed soil at the side of the trench below the grade level; and filling the impermeable liner in the trench with fill material, so that water filtering through the disturbed soil about the building foundation will reach undisturbed soil and flow over the undisturbed soil and over the edge section together with the impermeable liner and into the lined trench.

6. A method according to claim 5, wherein said step of providing the trench about the foundation comprises: the trench being at least as deep as the disturbed soil about the foundation and having sides, at least one side being bounded by undisturbed soil, and a bottom further comprises the trench having a first end, a second end, the second end terminating in a sump pit.

7. A method according to claim 6, wherein said step of covering the trench with the impermeable liner further comprises extending the impermeable liner into the sump pit.

8. A method according to claim 7, wherein the step of filling the trench with fill material comprises providing gravel fill material, placing the gravel fill material over the bottom of the trench.

9. A method according to claim 8, and further comprising providing a section of perforated pipe, and placing the perforated pipe over the gravel, filling the trench with gravel to cover the perforated pipe, and filling the trench with backfill.

10. A drainage system preventing the accumulation of water below a grade level of a perimeter area about a building foundation and soil surrounding the building, the building foundation being on disturbed soil and extending to a depth below the grade level, the system comprising: a trench about the foundation, the trench having at least two sides and a bottom, one of the sides being next to the building foundation;

a drapable impermeable liner, said drapable liner covering the bottom and at least a portion of the sides of said trench, a portion of the liner being attached to a strip of substantially rigid edge material, the liner and edge material being buried in one of the sides of said trench, below the grade level; and fill material over said impermeable liner, so that water flowing down form the grade level and over one of the sides of said trench encounters the edge material, so that the edge material allows the water to flow over the edge material and over said liner.

11. A drainage system according to claim 10 wherein said trench include at least one sump pit and said impermeable liner extends into the sump pit.

12. A drainage system according to claim 10 wherein said trench include at least two high points and at least two low points, each low point having at least one sump pit.

13. A drainage system according to claim 12 wherein said impermeable liner extends into each of the sump pits.

* * * * *